United States Patent [19]

Tucker

[11] 4,151,731

[45] May 1, 1979

[54] PICK RESISTANT CYLINDER LOCK

[76] Inventor: James I. Tucker, 1806 9th St., Manhattan Beach, Calif. 90266

[21] Appl. No.: 870,671

[22] Filed: Jan. 19, 1978

[51] Int. Cl.[2] ..... E05B 27/04

[52] U.S. Cl. ..... 70/364 A; 70/378; 70/386; 70/419

[58] Field of Search ..... 70/364 R, 364 A, 378, 70/386, 419, 421

[56] References Cited

U.S. PATENT DOCUMENTS

| | | | |
|---|---|---|---|
| 2,596,720 | 5/1952 | Pastor | 70/378 |
| 3,286,494 | 11/1966 | Sussine | 70/419 |
| 3,395,558 | 8/1968 | Russell | 70/364 A |

*Primary Examiner*—Robert L. Wolfe
*Attorney, Agent, or Firm*—John Holtrichter, Jr.

[57] ABSTRACT

The specification describes a cylinder lock including a plurality of driver and associated follower pins movably residing in axially alignable bores in the lock core and cylinder, the lock also including spheres normally located in notches in the outer extremity of core cylinder wall, one or more of the spheres moving to a position between associated driver and follower pins preventing the alignment of these associated pins at the peripheral surface of the core when the follower or tumbler pins are manipulated without the use of a properly designed key.

6 Claims, 6 Drawing Figures

PICK RESISTANT CYLINDER LOCK

BACKGROUND OF THE INVENTION

The background of the invention will be set forth in two parts.

1. Field of the Invention

The present invention pertains to key operated cylinder locks, and more particularly to a pick-resistant cylinder lock.

2. Description of the Prior Art

A conventional lock utilizing tumbler pins including a cylinder having spring-loaded driver pins mounted therein for radial movement against key-activated tumbler or follower pins located in a core rotatably mounted in the cylinder.

Structural means is provided on the core for maintaining the pin holes in the core in axial alignment with the pin holes in the cylinder so that the driver pins are free to pass through the shear line between the core and the cylinder and into the cavities holding the follower pins. When a key designed for the lock is inserted into the key slot in the cylinder, the key engages the follower pins and moves them to a position where the abutting faces of the pins lie along the shear line, permitting the core to be rotated with respect to the cylinder by rotation of the key. This type of lock is very susceptible to being picked, or unlocked by unauthorized persons, by simply inserting a wire, or other elongated instrument, or instruments, which is manipulated in such a way as to simultaneously place a rotational force on the core of the lock while moving the follower pins, one at a time, into shear alignment with the peripheral surface of the core. The rotational force is necessary in order to capture a follower pin in its shear position while manipulating the other such pins of the lock, until all are in proper alignment to allow the core to be rotated.

Several cylinder locks have been developed in the past which are designed to resist the picking of same by unauthorized persons. One such lock is decribed in U.S. Pat. No. 2,596,720 in which the spring-loaded driver pins are provided with reduced diameter terminations abutting spacer disks or different diameter balls riding on an associated tumbler pin. In accordance with this design, each of the bores of the core are flanked by two relatively shallow recesses, or grooves, extending over a limited arch of the periphery of the barrel, or core, the depth of the grooves increasing toward the extremities remote from each bore to form an abutment. Accordingly, when an attempt is made to pick the lock, the core will begin to rotate as soon as the top of a disk lies flush with its periphery. The end terminations of the driver pins now ride in the grooves, and the maximum angle of rotation which will be reached after all the tumbler pins have been picked, is fixed by the abutments, which is insufficient to retract a latch controlled by the lock. It can thus be seen that each of the aligned tumbler bores must carry a plurality of relatively small components or elements, some of which must be relied on to carry extreme shear load in the case where an attempt is made to pick the lock.

Also, this type of lock can be picked by raising all the pins into the housing and then gradually lowering them, thus placing the wafers, or balls, in their normal position on the core. It can further be seen that this type of prior art design relies on luck or the law of averages that the small tipped pin, or the small ball, will be in position to lock into the depression.

SUMMARY OF THE INVENTION

In view of the foregoing factors and conditions characteristic of the prior art, it is a primary object of the present invention to provide an improved pick resistant cylinder lock.

Another object of the present invention is to provide a relatively simple to construct and reliable pick resistant cylinder lock.

In accordance with an embodiment of the present invention, the lock is of the type having a cylinder and a latch-actuating core rotatably mounted in the cylinder. The core is rotatable by use of a proper key in either a locking direction or an opposite unlocking direction, and the cylinder and core include a plurality of radially-extending, in-line elongated bores. Each of the cylinder bores are axially alignable with an associated one of the core bores, spring-loaded driver pins being primarily located in the cylinder bores, and key-operated follower pins being primarily located in the core bores. Each of the driver pins is normally in contact with an associated one of the follower pins to urge same toward the center of the core. The invention also includes pick-resistant means having a separate pin accepting depression in the outer cylindrical surface of the core which communicates with at least one of the core bores. The depressions extend from an associated bore in the locking direction for limiting the rotation of the core relative to the cylinder to an amount insufficient to release the latch. The pick-resistant means also includes pick-sensing means including a sphere and a notch extending between each of the depressions and their associated core bores. Each of the notches is dimensioned to house a sphere, in a space defined by the walls of the notch, the cylindrical wall of the cylinder and the cylindrical surface of the pins, and is designed to allow the sphere to fall on top of the follower pin when the core is rotated in the unlocking direction only when the follower pin is not at the shear line.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawing in which like reference characters refer to like elements in the several views.

Figure 1:
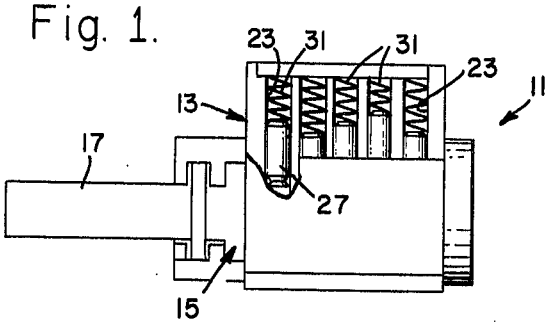
FIG. 1 is a longitudinal cross-sectional representation, partially broken away, showing a pick resistant cylindrical lock constructed in accordance with the present invention.
Figure 6:
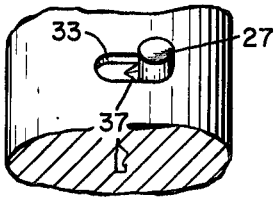
FIG. 6 is an enlarged perspective view of a portion of the lock's core showing one of the follower pins and the associated shallow shelf and notch, in accordance with the teachings of the present invention.
Figure 2:
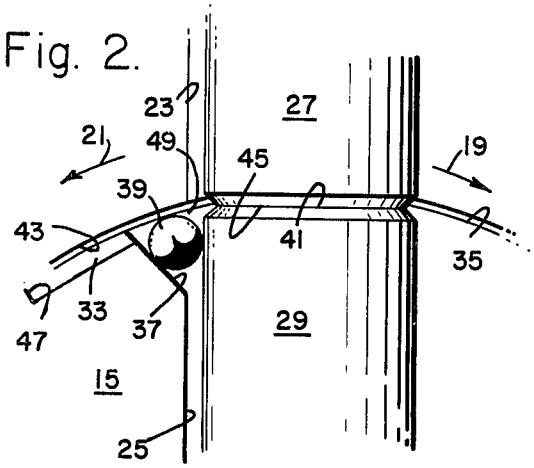
FIG. 2 is a cross-sectional view of the lock of FIG. 1 taken along line 2—2, and illustrating the relative positions of the operating elements prior to a normal unlocking operation.

DESCRIPTION OF THE PREFERRED EMBODIMENTS:

Referring to the drawing, and in particular to FIGS. 1 and 2, there is shown an improved pick-resistant cylindrical lock, generally designated 11. The lock 11 is of the type having a cylinder 13 and a core 15 rotatably mounted in the cylinder 13 the core being coupled to a latch 17 and rotatable in either an unlocking 19 or opposite locking 21 direction by the use of a proper key. The cylinder 13 and the core 15 include a plurality of radially-extending, in-line elongated bores 23 and 25, respectively, each of the bores 23 being axially alignable with an associated one of the core bores 25.

Driver pins 27 are slidably disposed primarily in the cylinder bores 23 while follower pins 29 primarily reside in the core bores 25. The driver pins 27 are urged toward the follower pins by suitable coil springs 31, captured in the bores 23.

In accordance with the present invention, a relatively shallow shelf or depression 33 is provided in the outer cylindrical surface 35 of the core 15, which depression extends from the bore 25 in the direction 21. Also provided in the core 15 is a notch 37 within the depression 33 and extending downwardly toward the bore 25, as shown in FIGS. 2–6. Normally residing within the notch 37 is a relatively small sphere 39. The sphere is normally captured in the notch 37 in the position shown in FIGS. 2 and 3 by the normal location of either the follower or driver pins.

Figure 3:
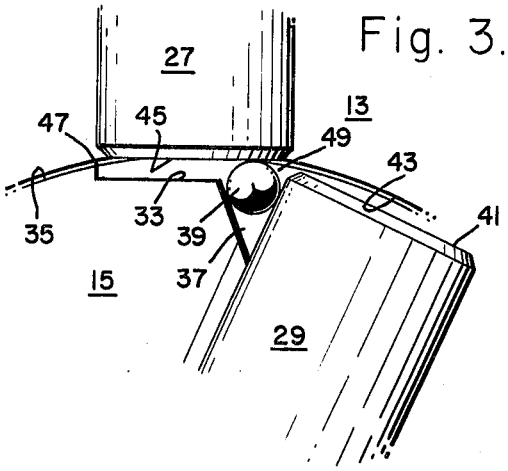
FIG. 3 is a cross-sectional view taken along line 2—2 in FIG. 1, showing a normal unlocking operation.

In a normal unlocking operation, as depicted in FIGS. 2 and 3, a proper key is inserted into a keyslot in the core to move each follower pin so that its upper surface 41 is at the shear line between the surface 35 and the inner cylindrical surface 43 of the cylinder 13. With the lower surface 45 of the driver pin 27 resting on the follower pin's upper surface 41, the core 15 may be rotated in the direction 19 until the latch 17 is fully actuated.

As shown in FIG. 3, while initially rotating the core 15, the driver pin is supported so that its lower surface 45 remains at the shear line, at least until the leading edge 47 of the core just beyond the depression 33 is in position to support the driver pin for the remainder of the rotating operation.

It should be understood that in order to successfully "pick" a conventional cylinder type lock (one without a notch and sphere), a mild but constant torque must be applied to the core 15 in the unlocking direction 19 while manipulating the follower pins 29, usually one at a time, by a wire or other tool. The torque is necessary to cause the core to rotate enough so that the trailing edge 49 of the core bore 25 just supports the bottom surface 45 of the driver pin associated with a follower pin that has been raised to where the abutting surfaces of the pins are at the shear line. After all the driver pins are supported on their respective ledges 49, the core is free to be rotated to its full extent, unlocking the lock.

Figure 4:
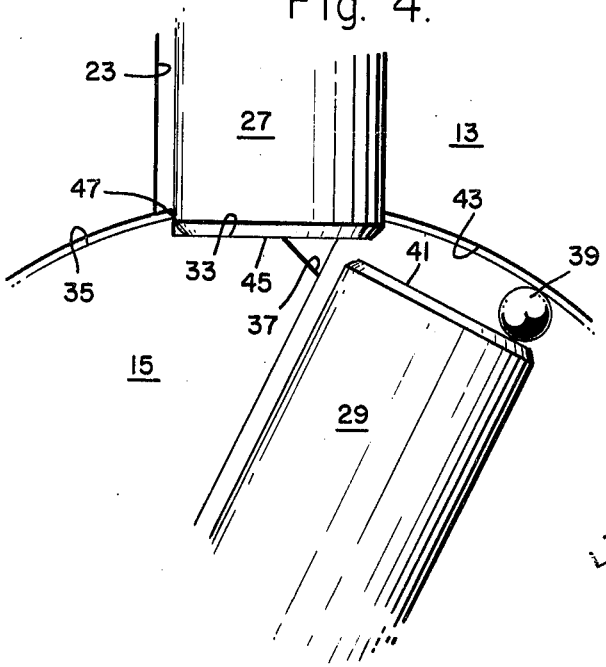
FIG. 4 is another cross-sectional view taken along the same line, but showing the tamper proof operation of the lock according to the present invention.

The distinction between the present lock and conventional locks is that as soon as a picking tool is moved from a first follower pin in order to manipulate another follower pin, the first follower pin will fall, allowing the sphere 39 to leave its normal residence in the notch 37. The associated driver pin 27 will then also fall and be supported by the upper surface of the depression 33. Once in this position, the core's rotation is severely restricted because the pin 27 wll soon strike the trailing edge 47 of the notch 33, as illustrated in FIG. 4.

Subsequent use of a proper key in the lock 11 will raise the follower pins 29 so that the upper surfaces 41 of all the pins are at the shear line. The core may then be rotated in the direction 19. Any spheres which have fallen on top of the follower pins will be forced by the unlocking operation into their respective notches, and the lock will again be in its normal configuration, as shown in FIG. 1.

In contrast to some prior art techniques which use relatively small movable elements to withstand the force applied to the core when the lock is being picked, the spheres utilized in the present invention are not subjected to any substantial force. Instead, the external forces present when attempting to pick the lock 11 are concentrated between the driver pins 27 and the trailing edges 47 of the depressions 33.

Figure 5:
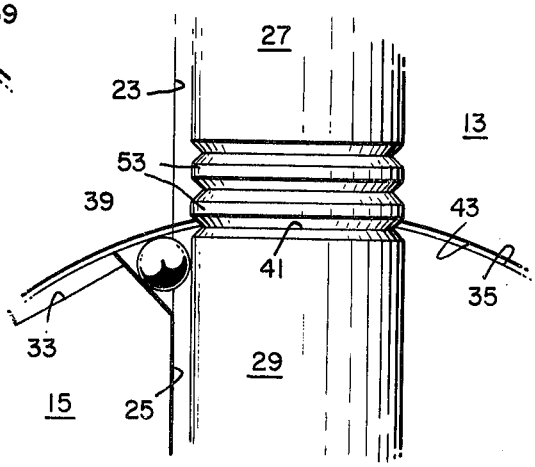
FIG. 5 is a cross-sectional view of a lock similar to that shown in FIG. 1, but including elements allowing the lock to be properly operated by one or more master keys as well as the normal key.

Referring now to the embodiment 51 of the invention, as illustrated in FIG. 5, one or more spacers or wafers 53 are positioned between the opposing pins in each of the axially alignable bores. The wafers are dimensioned, and master keys designed, to always present a juncture of two abutting surfaces at the shear line. The operation of the pick resistant elements of the invention is similar to that described previously, in that the sphere 39 will not support the driver pin 27, or any of the wafers 53, at the shear line and will thus allow it to fall into the depression 33 in one or more of the aligned bores, if the core is rotated without the use of either the primary key or one of the specially designed master keys.

The use of the wafers 53 in conjunction with master keys is well known in the art, and the design of the wafers and keys will, therefore, not be described here in detail. However, the height dimension of the wafers should be greater than the depth dimension of the depression so that a wafer residing in the depression will not act to support an associated driver pin at the shear line.

In the case of an unsuccessful attempt to pick a master lock system utilizing the teachings of the present invention, and where the sphere happens to fall below one or more of the master wafers, only the primary key or those master keys associated with wafers located below the sphere may be utilized to unlock the device 11.

In accordance with another embodiment of the present invention, the diameter of selected spheres 39 may be different than the spheres associated with the other pins by a predetermined increment related to the increments of follower pin length provided by different manufacturers. For example, some manufacturers use 0.015 inch increments between follower pins in a particular lock. A lock manufacturer, in fact, may produce up to 10 different follower pin lengths, successively differing by 0.015 inch. Accordingly, one or more of the spheres 39 may have different diameters in like increments. Of course, the dimensions of the notches 37 would be tailored to accommodate the dimension of the sphere normally housed therein.

From the foregoing, it should be evident that there has been described an improved pick resistant cylinder lock that is relatively simple to construct and reliable in operation, and that is designed to withstand significantly greater forces than can some other pick resistant designs.

Although exemplary embodiments of the invention have been described in detail, changes and modifications and other embodiments of the invention may be made by one having ordinary skill in the art without necessarily departing from the spirit and scope of the invention.

What is claimed is:

1. A cylinder lock resistant to being functionally operated without the use of a proper key, comprising:

a lock cylinder;

a lock core rotatably mounted in said cylinder, said cylinder and said core including a plurality of axially alignable elongated in-line bores extending perpendicularly to the axis of rotation of said core;

spring-loaded driver pins located primarily in said bores of said cylinder;

key-operated follower pins located primarily in said bores of said core, each of said driver pins normally using an associated one of said follower pins toward the center of said core;

pick-resistant means including a separate driver pin-accepting depression in the outer cylindrical surface of said core communicating with at least one of said core bores, and also including a sphere and an associated notch extending into one of said core bores from an associated one of said depressions, said notches normally housing an associated one of said spheres for allowing said spheres to fall on top of said follower pins when said core is rotated while the top of at least one of said follower pins is not at the shear line between cylinder and said core.

2. The cylinder lock according to claim 1, wherein the depths of said depressions are less than the diameters of said spheres.

3. The cylinder lock according to claim 1, wherein outer surfaces of said spheres are at said shear line when said spheres are located in their respective notches and retained by said follower pins.

4. The cylinder lock according to claim 1, wherein said depressions extend from said core bores in a direction opposite that said core rotates to operate said lock.

5. The cylinder lock according to claim 1, wherein said spheres and said notches are dimensioned to support an associated one of said driver pins at said shear line until said driver pin is supported by the cylindrical surface of said core only when the tops of said follower pins are maintained at said shear level while said core is being rotated to operate said lock.

6. The cylindrical lock according to claim 1, also comprising at least one master wafer normally disposed between associated ones of said driver and follower pins.

* * * * *